US011946126B2

(12) United States Patent
Ishimaru et al.

(10) Patent No.: US 11,946,126 B2
(45) Date of Patent: Apr. 2, 2024

(54) WELDED STRUCTURE AND STORAGE TANK

(71) Applicant: NIPPON STEEL STAINLESS STEEL CORPORATION, Tokyo (JP)

(72) Inventors: Eiichiro Ishimaru, Tokyo (JP); Takuya Sakuraba, Tokyo (JP); Yuji Kaga, Tokyo (JP); Toyohiko Kakihara, Tokyo (JP)

(73) Assignee: NIPPON STEEL STAINLESS STEEL CORPORATION, Tokyo (JP)

( * ) Notice: Subject to any disclaimer, the term of this patent is extended or adjusted under 35 U.S.C. 154(b) by 27 days.

(21) Appl. No.: 17/780,264

(22) PCT Filed: Mar. 31, 2021

(86) PCT No.: PCT/JP2021/013907
§ 371 (c)(1),
(2) Date: May 26, 2022

(87) PCT Pub. No.: WO2021/201122
PCT Pub. Date: Oct. 7, 2021

(65) Prior Publication Data

US 2022/0411909 A1 Dec. 29, 2022

(30) Foreign Application Priority Data

Mar. 31, 2020 (JP) ..... 2020-064501

(51) Int. Cl.
*C22C 38/44* (2006.01)
*B65D 88/02* (2006.01)
(Continued)

(52) U.S. Cl.
CPC ..... *C22C 38/58* (2013.01); *B65D 88/02* (2013.01); *C22C 38/001* (2013.01); *C22C 38/02* (2013.01);
(Continued)

(58) Field of Classification Search
CPC .... B65D 2588/02; B65D 88/02; C22C 38/00; C22C 38/001; C22C 38/02; C22C 38/42; C22C 38/44; C22C 38/58; C22C 38/60
See application file for complete search history.

(56) References Cited

U.S. PATENT DOCUMENTS

2009/0053551 A1 2/2009 Sakamoto et al.

FOREIGN PATENT DOCUMENTS

JP H0649233 B2 * 6/1994
JP 3179194 B2 6/2001
(Continued)

OTHER PUBLICATIONS

International Search Report for PCT/JP2021/013907 dated Jun. 29, 2021.
(Continued)

*Primary Examiner* — Jenny R Wu
(74) *Attorney, Agent, or Firm* — Birch, Stewart, Kolasch & Birch, LLP

(57) ABSTRACT

A welded structure including a base material made of duplex stainless steel and a welded portion formed by welding the base materials to each other, wherein the base material has a predetermined chemical composition, a volume fraction of a ferrite phase in a metallographic structure of a weld metal of the welded portion is 45 to 75%, a ratio of a hardness of the weld metal to a hardness of the base material is 0.80 to 1.20, and an amount of precipitates formed in the ferrite phase of the weld metal is less than 10% in area fraction.

8 Claims, 1 Drawing Sheet

(51) Int. Cl.

| | |
|---|---|
| ***C22C 38/00*** | (2006.01) |
| ***C22C 38/02*** | (2006.01) |
| ***C22C 38/42*** | (2006.01) |
| ***C22C 38/58*** | (2006.01) |

(52) U.S. Cl.
CPC ..... *C22C 38/42* (2013.01); *C22C 38/44* (2013.01); *B65D 2588/02* (2013.01)

(56) References Cited

FOREIGN PATENT DOCUMENTS

| | | | | |
|---|---|---|---|---|
| JP | 2010-65279 | A | | 3/2010 |
| JP | 2011-173124 | A | | 9/2011 |
| JP | 5010323 | B2 | | 8/2012 |
| JP | 2014-84493 | A | | 5/2014 |
| JP | 2018-168461 | A | | 11/2018 |
| JP | 2018168461 | A | * | 11/2018 |
| WO | WO2008/062650 | A1 | | 5/2008 |

OTHER PUBLICATIONS

Chinese Office Action and Search Report for corresponding Chinese Application No. 202180006909.6, dated Apr. 7, 2023, with English translation.

* cited by examiner

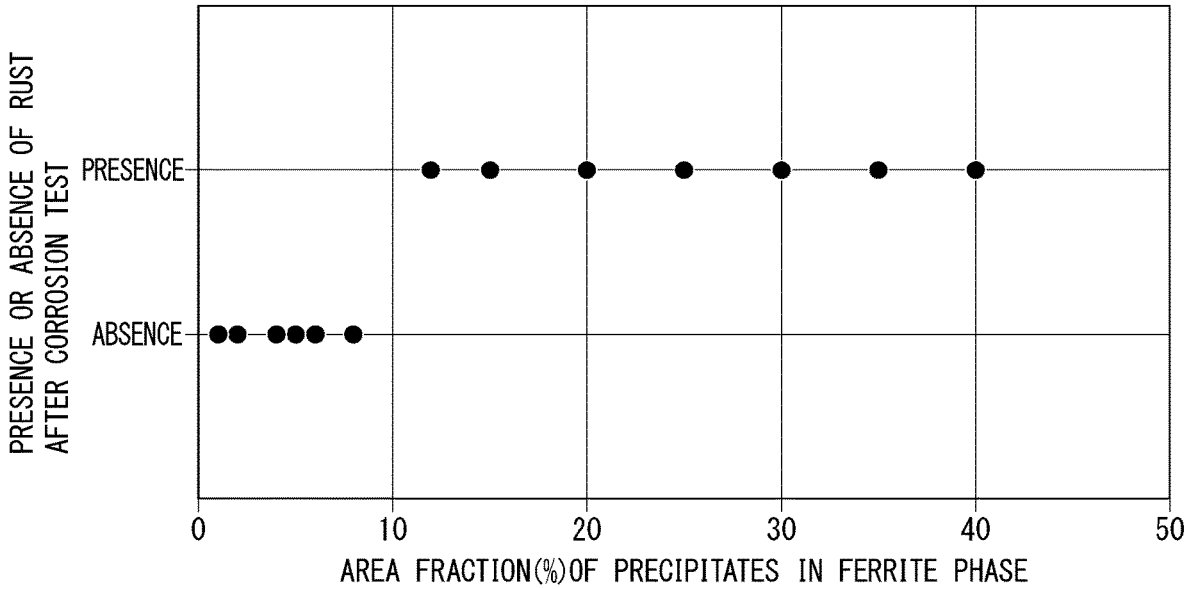
PRESENCE OR ABSENCE OF RUST AFTER CORROSION TEST
PRESENCE
ABSENCE
0
10
20
30
40
50
AREA FRACTION(%)OF PRECIPITATES IN FERRITE PHASE

WELDED STRUCTURE AND STORAGE TANK

TECHNICAL FIELD

The present invention relates to a welded structure, particularly a welded structure and a storage tank that are suitably applicable to a hot water storage tank for storing hot water and a beverage storage tank for storing beverages.

Priority is claimed on Japanese Patent Application No. 2020-064501, filed Mar. 31, 2020, the content of which is incorporated herein by reference.

BACKGROUND ART

Stainless steel is used as a material for hot water storage tanks that store hot water and beverage storage tanks that store beverages due to exceptional corrosion resistance in a wet environment. The hot water to be stored includes, for example, tap water, well water, hot spring water, and the like, and a temperature thereof ranges from room temperature to a temperature less than 100° C. Further, examples of the beverage to be stored include beverages containing fruit juice, various electrolytes, weak acids and the like and having a relatively low pH. Conventionally, ferritic stainless steel and austenitic stainless steel have been used as stainless steels applicable to such applications. For example, Patent Literature 1 below describes a hot water container made of ferritic stainless steel. Further, Patent literature 2 below describes a container for hot water in which a container wall is made of ferritic stainless steel and a material to be welded thereto is made of austenitic stainless steel.

However, ferritic stainless steels and austenitic stainless steels have a lower proof stress than duplex stainless steels. Therefore, it is necessary to increase the thickness in order to have a predetermined strength, and thus there is a problem that the demand for a thin wall and a light weight cannot be sufficiently met. Further, since austenitic stainless steel contains a large amount of relatively expensive alloy components, there is a problem that it is disadvantageous in terms of cost. On the other hand, since duplex stainless steel has a relatively high proof stress, it can meet the demand for a thin wall and a light weight, and since the content of expensive alloy components is relatively small, it is advantageous in terms of cost.

However, in a base material of the duplex stainless steel, the ratio of a ferrite phase to an austenite phase is controlled to be approximately 1:1 by heat treatment in order to ensure exceptional corrosion resistance. However, when welding is performed on duplex stainless steel, a fraction of the ferrite phase in a weld metal becomes higher than that of the base material when the weld metal is cooled from a molten state in a short time. When the fraction of the ferrite phase in the weld metal is high, the austenite phase having a large amount of solid solution of N is reduced, and N is concentrated in the ferrite phase. However, since the amount of solid solution of N in the ferrite phase is very small, excess N that exceeds a solution limit binds to Cr to precipitate Cr nitride. As a result, in the duplex stainless steel, there is a problem that a Cr-depleted zone is formed in the weld metal, and thus, the corrosion resistance of the weld metal and a weld heat-affected portion is lowered.

CITATION LIST

Patent Document

[Patent Document 1]
Japanese Patent No. 5010323
[Patent Document 2]
Japanese Patent No. 3179194

SUMMARY OF INVENTION

Problems to be Solved by the Invention

The present invention has been made in view of the above circumstances, and an object of the present invention is to provide a welded structure made of duplex stainless steel which has exceptional proof stress and corrosion resistance at a welded portion. Another object of the present invention is to provide a storage tank having such a welded structure.

Means for Solving the Problem

In order to solve the above problems, a welded structure according to one aspect of the present invention has the following requirements.

[1] A welded structure according to one aspect of the present invention is a welded structure including a base material made of duplex stainless steel and a welded portion in which the base materials are welded to each other, wherein a chemical composition of the base material includes, in mass %, C: 0.050% or less, Si: 0.03 to 5.00%, Mn: 0.01 to 8.00%. P: 0.070% or less, S: 0.0500% or less, Ni: 1.0 to 30.0%, Cr: 15.0 to 30.0%. Mo: 0.010 to 8.000%, Cu: 0.010 to 5.000%, N: 0.050 to 0.800%, Al: 0 to 1.00%, Ti: 0 to 0.400%, Nb: 0 to 0.40%, V: 0 to 0.50%, W: 0 to 1.0%, Zr: 0 to 0.200%, Ta: 0 to 0.100%, Sn: 0 to 0.50%, Sb: 0 to 0.50%, Ga: 0 to 0.50%, B: 0 to 0.0050%, Ca: 0 to 0.0050%, Mg: 0 to 0.0050%, and REM: 0 to 0.10%, and the remainder of Fe and impurities, a volume fraction of a ferrite phase in a metallographic structure of a weld metal of the welded portion is 45 to 75%, a ratio of a hardness of the weld metal to a hardness of the base material is 0.80 to 1.20, and an amount of precipitates formed in the ferrite phase of the weld metal is less than 10% in area fraction.

In the welded structure described in [1], the base material may contain one or more selected from the following first and second groups.

First group: in mass %,
Al: 1.00% or less,
Ti: 0.010 to 0.400%,
Nb: 0.01 to 0.40%,
V: 0.01 to 0.50%,
W: 0.01 to 1.0%,
Zr: 0.001 to 0.200%,
Ta: 0.001 to 0.100%,
Sn: 0.001 to 0.50%,
Sb: 0.001 to 0.50%, and
Ga: 0.001 to 0.50%.

Second group: in mass %,
B: 0.0002 to 0.0050%,
Ca: 0.0002 to 0.0050%,
Mg: 0.0002 to 0.0050%, and
REM: 0.001 to 0.10%.

[3] In the welded structure described in [1] or [2], a proof stress of the base material may be 500 MPa or mare, and a proof stress of the welded portion may be 440 MPa or more.

[4] A welded structure described in any one of [1] to [3] may be for a storage tank for hot water.

[5] A welded structure described in any one of [1] to [3] may be for a storage tank for beverages.

[6] A storage tank according to another aspect of the present invention is a storage tank for liquids and has the welded structure described in any one of [1] to [3].

[7] In the storage tank described in [6], the liquid may be one or more of water, beverages, hot water, and dairy products.

Effects of the Invention

According to the above aspect of the present invention, it is possible to provide a welded structure made of duplex stainless steel having exceptional proof stress and exceptional corrosion resistance in a welded portion, and a storage tank having such a welded structure.

BRIEF DESCRIPTION OF DRAWINGS

FIG. 1 is a graph showing a relationship between an area fraction of precipitates in a ferrite phase of a weld metal and the presence or absence of rust after a corrosion test.

EMBODIMENTS OF THE INVENTION

Hereinafter, one embodiment of the welded structure of the present embodiment and one embodiment of the storage tank of the present embodiment will be described in detail.

<Welded Structure>

The welded structure of the present embodiment includes a base material made of duplex stainless steel and a welded portion in which the base materials are welded to each other. The base material is, for example, a duplex stainless steel sheet.

Hereinafter, the base material and the welded portion will be described.

(Base Material)

Limiting ranges in an amount of content of a chemical composition of duplex stainless steel and reasons therefor will be explained. Hereinafter, the % symbol indicating a composition of steel means "mass %" unless otherwise specified.

C: 0.050% or Less

When C is contained in an amount of more than 0.050%, Cr carbide is generated, and corrosion resistance is deteriorated. Therefore, in order to ensure the corrosion resistance of the base material, a C content is limited to 0.050% or less. The C content is preferably 0.030% or less.

On the other hand, C is an element that forms austenite that constitutes a two-phase structure. Therefore, the C content is preferably 0.005% or more, and more preferably 0.010% or more.

Si: 0.03 to 5.00%

Si is contained in an amount of 0.03% or more for deoxidation. A Si content is preferably 0.10% or more, and more preferably 0.30% or more. However, when Si is contained in excess of 5.00%, precipitation of an a phase is promoted. Therefore, the Si content is limited to 5.00% or less. The Si content is preferably 2.00% or less, and more preferably 0.60% or less.

Mn: 0.01 to 8.00%

Mn is contained in an amount of 0.01% or more as a deoxidizing material and an austenite stabilizing element for forming a two-phase structure. A Mn content is preferably 0.10% or more, and more preferably 1.50% or more. However, when Mn is contained in excess of 8.00%, the corrosion resistance is deteriorated. Therefore, the Mn content is limited to 8.00% or less. The Mn content is preferably 5.00% or less, and more preferably 4.00% or less.

P: 0.070% or Less

Since P deteriorates hot workability and toughness, a P content is limited to 0.070% or less. The P content is preferably 0.050% or less, and more preferably 0.035% or less. On the other hand, although it is preferable that the P content be low, when the P content is excessively reduced, refining costs become high. Therefore, from the viewpoint of cost, the P content is preferably 0.005% or more.

S: 0.0500% or Less

Since S deteriorates the hot workability, the toughness and the corrosion resistance, an S content is limited to 0.0500% or less. The S content is preferably 0.0100% or less, and more preferably 0.0010% or less. On the other hand, although it is preferable that the S content be low, when the S content is excessively reduced, raw material costs and refining costs will increase. Therefore, from the viewpoint of cost, the S content is preferably 0.0003% or more.

Ni: 1.0 to 30.0%

When Ni is contained in a passivation film of stainless steel, generation of pitting corrosion is curbed (reduced) when the Fe concentration of the passivation film is high and progress of corrosion is curbed when the corrosion occurs. When the Ni content is less than 1.0%, sufficient corrosion resistance cannot be obtained. Therefore, the Ni content is set to 1.0% or more. The Ni content is preferably 2.0% or more, and more preferably 4.0% or more.

On the other hand, when the Ni content exceeds 30.0%, a Cr concentration of the film is too low, and thus sufficient corrosion resistance cannot be obtained. Therefore, it is necessary to reduce the Ni content to 30.0% or less. The Ni content is preferably 15.0% or less, more preferably 10.0% or less, and still more preferably 7.0% or less.

Cr: 15.0 to 30.0%

When a Cr content is less than 15.0%, sufficient corrosion resistance cannot be obtained. Therefore, it is necessary to increase the Cr content to 15.0% or more. The Cr content is preferably 18.0% or more, more preferably 20.0% or more, and still more preferably 21.0% or more.

On the other hand, when the Cr content exceeds 30.0%, the Cr concentration in the passivation film becomes high, and sufficient corrosion resistance cannot be obtained in an environment in which a natural potential of stainless steel is high. In addition, the precipitation of the a phase increases, and the corrosion resistance and hot manufacturability are deteriorated. Therefore, it is necessary to reduce the Cr content to 30.0% or less. The Cr content is preferably 28.0% or less, and more preferably 25.0% or less.

Mo: 0.010 to 8.000%

Mo is an element that improves the corrosion resistance of the base material, and an effect thereof is exhibited when it is contained in an amount of 0.010% or more. Therefore, a Mo content is 0.010% or more. The Mo content is preferably 0.050% or more, and more preferably 1.000% or more.

On the other hand, as long as there is 8.000% or less thereof, Mo may be contained, but when the Mo content exceeds 4.000%, the 6 phase is likely to precipitate during hot working. Therefore, the Mo content is 8.000% or less, preferably 4.000% or less, and more preferably 1.500% or less.

Cu: 0.010 to 5.000%

When 0.010% or more of Cu is contained, the curbing effect on the progress of corrosion when corrosion occurs can be obtained. Therefore, a Cu content is 0.010% or more. The Cu content is preferably 0.050% or more, and more preferably 0.200% or more.

On the other hand, when an amount thereof is 5.000% or less, Cu may be contained, but when the Cu content exceeds 3.000%, cracks are likely to occur during casting. Therefore, the Cu content is 5.000% or less, preferably 3.000% or less, and more preferably 0.500% or less.

N: 0.050 to 0.800%

N is an effective element for enhancing corrosion resistance, and when 0.050% or more of N is contained, the corrosion resistance is improved. Therefore, an N content is 0.050% or more. The N content is preferably 0.100% or more, and more preferably 0.120% or more.

On the other hand, when more than 0.800% of N is contained, bubbles are likely to be generated during casting. Therefore, the N content is 0.800% or less. The N content is preferably 0.300% or less, and more preferably 0.180% or less.

In the present embodiment, in addition to the above-described elements, the base material may contain one or more alloying elements selected from the following first group and second group for the purpose of adjusting various properties of steel. However, since these elements do not have to be contained, a lower limit is 0%.

First group: Al: 1.00% or less, TI: 0.010 to 0.400%, Nb: 0.01 to 0.40%, V: 0.01 to 0.50%, W: 0.01 to 1.0%, Zr: 0.001 to 0.200%, Ta: 0.001 to 0.100%, Sn: 0.001 to 0.50%, Sb: 0.001 to 0.50%, and Ga: 0.001 to 0.50% in mass %.

Second group: B: 0.0002 to 0.0050%, Ca: 0.0002 to 0.0050%, Mg: 0.0002 to 0.0050%, and REM: 0.001 to 0.10% in mass %.

First group: Al, Ti, Nb, V, W, Zr, Ta, Sn, Sb, Ga

Al: Al is useful as a deoxidizing element, but it should not be contained in a large amount because it deteriorates workability. An Al content should be limited to 1.00% or less. A preferred range of the Al content is 0.50% or less. The Al content may be 0.01% or more.

Ti, Nb, V, W, Zr, Ta, Sn, Sb, and Ga are elements that improve corrosion resistance, and may be contained alone or in combination of two or more within the following ranges.

Ti: 0.010 to 0.400%, Nb: 0.01 to 0.40%. V: 0.01 to 0.50%, W: 0.01 to 1.0%, Zr: 0.001 to 0.200%, Ta: 0.001 to 0.100%, Sn: 0.001 to 0.50%, Sb: 0.001 to 0.50%, and Ga: 0.001 to 0.50%.

Ti: 0.010 to 0.400%

Nb: 0.01 to 0.40%

Ti and Nb have an action of fixing C and N as carbonitride to improve corrosion resistance, and particularly an action of curbing intergranular corrosion. Therefore, one or both of Ti and Nb may be contained. The effects thereof are exhibited when at least one of a Ti content is 0.010% or more and a Nb content is 0.01% or more.

On the other hand, even when it is contained in an excessive amount, the effects become saturated. Therefore, the Ti content is 0.400% or less, and the Nb content is 0.40% or less.

An appropriate content of Ti and Nb is preferably such that the total content of Ti and Nb is 5 times or more and 30 times or less the total content of C and N. More preferably, the total content of Ti and Nb is 10 times or more and 25 times or less the total content of C and N.

V: 0 to 0.50%, W: 0 to 1.0%

V and W are elements that improve corrosion resistance, particularly crevice corrosion resistance, and may be contained as necessary. When this effect is obtained, the content of each of V and W is preferably 0.01% or more. The V content and the W content are preferably 0.04% or more.

On the other hand, the inclusion of an excessive amount of V or W lowers the workability and also saturates the effect of improving the corrosion resistance. Thus, the V content is set to 0.50% or less, and the W content is set to 1.0% or less. The V content is preferably 0.30% or less. The W content is preferably 0.6% or less, and more preferably 0.5% or less.

Zr: 0 to 0.200%

Ta: 0 to 0.100%

Zr and Ta are elements that improve corrosion resistance by modifying inclusions and may be contained as necessary.

Further, since Zr is stably present as an oxide in the passivation film, it functions to strengthen the passivation film. Since the effect is exhibited by a Zr content of 0.001% or more, the Zr content is preferably 0.001% or more. The Zr content is preferably 0.010% or more.

On the other hand, when the Zr content is more than 0.200%, defects due to aggregation of oxides frequently occur. Therefore, the Zr content is set to 0.200% or less. The Zr content is preferably 0.100% or less.

Further, since the effect of Ta is exhibited by a content of 0.001% or more, it is preferable to set the lower limit of the Ta content to 0.001% or more.

On the other hand, when the Ta content is more than 0.100%, it causes a decrease in ductility at room temperature and a decrease in toughness. Therefore, the Ta content is preferably 0.100% or less, and more preferably 0.050% or less. When the effect is exhibited with a small amount of Ta content, the Ta content is preferably 0.020% or less.

Sn: 0 to 0.50%

Sb: 0 to 0.50%

When a small amount of Sn or Sb is contained, the corrosion resistance is improved. Therefore, Sn and Sb are elements useful for improving corrosion resistance and may be contained within a range that does not impair low cost. When Sn content or Sb content is less than 0.001%, the effect of improving corrosion resistance is not exhibited, and thus, it is preferable that the content of each of Sn and Sb be 0.001% or more. The content of each of Sn and Sb is preferably 0.01% or more.

On the other hand, when the content of Sn or Sb exceeds 0.50%, an increase in cost becomes apparent, and the workability also decreases. Therefore, the content of each of Sn and Sb is set to 0.50% or less. The content of each of Sn and Sb is preferably 0.30% or less.

Ga: 0 to 0.50%

Ga is an element that contributes to improvement of the corrosion resistance and the workability and may be contained. When the effect is obtained, a Ga content is preferably 0.001% or more. The Ga content is preferably 0.01% or more, and more preferably 0.015% or more.

On the other hand, when the Ga content exceeds 0.50%, the toughness is lowered, and manufacturability is significantly lowered. Therefore, the Ga content is set to 0.50% or less. The Ga content is preferably 0.30% or less.

Second group: B, Ca, Mg, REM

B: 0 to 0.0050%

Ca: 0 to 0.0050%

Mg: 0 to 0.0050%

REM: 0 to 0.10%

B, Ca, Mg, and REM are elements that improve hot workability, and one or more of them may be contained for that purpose. Since the effect of B, Ca, and Mg is exhibited at a content of 0.0002% or more, it is preferable that the content of each of B, Ca, and Mg be 0.0002% or more. In the case of REM, the content is preferably 0.001% or more. The content of each of B, Ca and Mg is more preferably 0.0005% or more. The REM content is more preferably 0.005% or more.

On the other hand, when an excessive amount of any of them is contained, the hot workability is deteriorated. Therefore, it is preferable to set the content as follows. That is, the content of each of B, Ca, and Mg is 0.0050% or less, and the REM content is 0.10% or less.

The content of each of B, Ca and Mg is preferably 0.0015% or less. The REM content is preferably 0.03% or less.

Here, REM (rare earth elements) refers to a general term for 2 elements including scandium (Sc) and yttrium (Y) and 15 elements (lanthanoids) from lanthanum (La) to lutetium (Lu) according to a general definition. These may be contained alone or as a mixture. The REM content is the total amount of these elements.

In the duplex stainless steel constituting the base material of the present embodiment, the remainder other than the above-described elements are Fe and impurities, but in addition to the above-described elements, other elements can be contained within a range that does not impair the effects of the present embodiment.

(Welded Portion)

Next, the welded portion will be described. A weld metal that has been melted and resolidified and a heat-affected portion that has not been melted but has been heat-affected during welding are formed in the welded portion. Hereinafter, a structure of the weld metal included in the welded portion will be described.

The fraction of the ferrite phase in the weld metal is set to a range of 45 to 75% in volume %.

The weld metal begins to solidify in the ferrite phase, becomes a complete solid phase and is then transformed into an austenite phase. When a cooling rate is relatively high as in welding, a sufficient time for solid phase transformation cannot be obtained, thus a ratio of the austenite phase decreases, and the ratio of the ferrite phase inevitably increases. However, it is difficult to obtain sufficient time for solid phase transformation during welding. The weld metal is hardened when the austenite phase is increased. In the welded structure of the present embodiment, a ferrite phase having a volume fraction of 45% or more is required in the weld metal in order to maintain sufficient workability in the welded portion. On the other hand, since solution limit concentrations of C and N in the ferrite phase are low, carbonitride is formed when the ferrite phase is increased. In this case, when Cr carbonitride is formed, a Cr-depleted zone is formed, but the Cr-depleted zone becomes a starting point of rust, which is a problem. Therefore, the volume fraction of the ferrite phase is set to 75% or less.

In the weld metal, the amount of precipitates is important in addition to the volume fraction of the ferrite phase. The precipitates are the starting point of rust in the welded portion of the duplex stainless steel. Therefore, when the duplex stainless steel is welded, welding conditions are often set so that forming of the precipitates are curbed, but in the welded structure of the present embodiment, since Cr carbonitride is difficult to be precipitated, and even when the Cr carbonitride is precipitated, Cr diffusion proceeds and the Cr-depleted zone is innocuous at the time when solid phase transformation to the austenite phase is possible, and when the precipitates are less than 10%, it does not serve as the starting point of rust. Therefore, the amount of precipitates formed in the ferrite phase is set to less than 10% in area fraction. Examples of the precipitates include Cr carbonitride.

In addition, the hardness of the weld metal has a great effect on the strength of the welded structure. The weld metal generally contains minute defects, and it is difficult to detect the minute defects. However, when the minute defects affect the strength of the structure, the weld metal itself shows a large change in hardness as compared with the base material. Therefore, the hardness of an arbitrary portion of the weld metal is measured, and the ratio of the hardness of the weld metal to the hardness of the base material (the hardness of the weld metal/the hardness of the base material) is set in a range of 0.8 to 1.2. The ratio of hardness is preferably in a range of 0.9 to 1.1.

Further, the welded structure of the present embodiment preferably has a base material having a proof stress of 500 MPa or more. Further, it is preferable that the proof stress of the welded portion (the proof stress of a welded joint containing the weld metal) be 440 MPa or more. It is possible to reduce the thickness and weight of the welded structure by setting the proof stress of the base material to 500 MPa or more and the proof stress of the welded portion to 440 MPa or more. Further, the strength of the entire welded structure can be increased, and the capacity of a hot water tank and a beverage tank can be increased.

The proof stress of the base material and the proof stress of the welded portion are measured by a tensile test. The tensile test is carried out under the conditions in accordance with JIS Z2241:2011.

For the proof stress of the base material, a JIS No. 13 B test piece is prepared, a test of n=2 is carried out, and a lower value is adopted.

For the proof stress of the welded part, when a JIS No. 13 B test piece in which the welded portion is disposed at a center of a parallel portion of the test piece is prepared, and when the welded portion is thicker than the base metal and is in a built-up state, grinding was performed to match a cross-sectional area shape with a parallel portion of the base metal. The test of n=2 is carried out, and a lower value is adopted.

The welded structure of the present embodiment can be suitably used as a storage tank for hot water.

Further, the welded structure of the present embodiment can be suitably used as a storage tank for beverages.

Duplex stainless steel is easily assumed to have a high proof stress and resistance to deformation. On the other hand, it is also known that the structure of the welded portion is coarsened and softened because it melts and changes to a solidified structure. That is, it is necessary to consider the deformation of the welded structure with the welded portion as a reference. Increasing a sheet thickness is a countermeasure to increase the strength against deformation but increasing the sheet thickness is accompanied by an increase in weight. When the weight increases, laying construction cost and transportation cost will increase, which will cause an economic disadvantage, and thus it is desirable to reduce the weight when possible. Therefore, the welded structure of the present embodiment in which the decrease in the strength of the welded portion is small has exceptional characteristics as the welded structure. Further, since the decrease in the strength is curbed by the structure control, the duplex stainless steel can also curb deterioration of corrosion resistance.

When a storage tank is manufactured from the welded structure of the present embodiment, for example, an end plate as the base material is manufactured by molding such as press working, and a tank body portion as the base material is manufactured, and these are welded to form a welded structure, and the welded structure is used to manufacture a storage tank.

In the welded structure of the present embodiment, since the strength of the base material is high, springback of the end plate is strong. Therefore, it becomes difficult to form a crevice structure in the vicinity of the welded portion between the tank body portion and the end plate. That is, usually, when a tank is manufactured, an end portion of the end plate overlaps an end portion of the tank body portion, and the welded portion is formed in the overlapping portion, but when the strength of the end plate is high, it becomes difficult to form the crevice structure in the vicinity of the welded portion.

Therefore, when a storage tank is manufactured using the welded structure of the present embodiment, crevice corrosion is less likely to occur, and corrosion resistance can be further improved.

<Storage Tank>

The storage tank of the present embodiment is a storage tank for liquids and has the above-described welded structure of the present embodiment. It may be made of the welded structure of the present embodiment.

The storage tank of the present embodiment includes an end plate and a body portion, and the end plate and the cylindrical body portion are joined by welding. The end plate and the body portion may be made of one stainless steel sheet or two or more stainless steel sheets joined by welding.

Next, a method of manufacturing the welded structure of the present embodiment will be described.

The welded structure of the present embodiment can be manufactured by welding duplex stainless steel having the above-described chemical composition according to predetermined welding conditions.

As a welding method, arc welding such as TIG welding, MIG welding, MAG welding, and coated arc welding can be applied. A welding material may or may not be used. When a welding material is used, a commonly used duplex stainless steel welding material can be used. Preferably, a welding material having a chemical composition close to the chemical composition of the base material is selected. As the chemical component of the welding material, for example, Type 2209 which is a welding material for duplex stainless steel manufactured by Nippon Steel Stainless Steel Corporation can be used, but the welding material is not limited thereto.

The welding material may be a welding rod, a solid wire, or a flux-cored wire.

A shield gas is used when the welding is performed. Any one of $N_2$, Ar, Ar+$O_2$, and He is used as the shield gas.

Due to the use of any one of these shield gases, it is possible to curb the suspension of oxygen in the atmosphere in the molten metal during welding and to avoid generation of finely dispersed oxides, and a hardness ratio of the weld metal to the hardness of the base material and an amount of precipitates in the welded portion can be set in preferable ranges.

When a shield gas other than these is used, the hardness ratio of the weld metal to the hardness of the base material and the amount of precipitates in the ferrite phase of the weld metal cannot be set in the preferable ranges. Further, for example, when the shield gas is $H_2$, it causes hydrogen embrittlement.

Embodiments

Hereinafter, in order to confirm the effects of the present invention, the following tests were carried out. One of embodiments of the present invention was tested, but the present invention is not limited to the following configurations. The present invention may adopt various conditions as long as requirements of the present invention are met and the object of the present invention is achieved.

The underlines in the tables indicate that it is out of the scope of the present invention.

Stainless steels having chemical components shown in Tables 1 and 2 were melted and cast in a vacuum induction melting furnace. Then, soaking was performed at 1200° C., and hot forging was performed. Steels were hot rolled to a thickness of 6.0 mm, annealed, and pickled. Then, the steals were cold-rolled to a thickness of 0.6 to 4.0 mm and further subjected to annealing, pickling, and an electrolytic treatment. From the above, a stainless steel sheet was manufactured as a base material.

Next, TIG welding or MIG welding was performed using the obtained stainless steel sheet as the base material. A welding material was supplied by a welding wire as needed. Specifically, two stainless steel sheets that were the base materials were prepared, and as an end face treatment, when the sheet thickness was less than 1.5 mm, it was as cut, and when the sheet thickness was 1.5 mm or more, a V groove was provided, and a welded joint was manufactured by performing butt welding by supplying a welding material with a welding wire as needed. The shield gas was as shown in Table 3, and a flow rate of the shield gas was adjusted so that external air did not come into contact with the welded portion.

The volume fraction of the ferrite phase in the obtained welded joint, a ratio (the hardness ratio) of the hardness of the weld metal to the hardness of the base material, and the amount of precipitates in the ferrite phase in the weld metal were measured. The results are shown in Table 4.

The weld metal shown here indicates a portion that has been melted and resolidified during welding and indicates a region in which a continuous layered structure from a base material portion is discontinuous when the etching treatment shown below is performed. A method for measuring a volume fraction of the ferrite phase in the weld metal, a hardness ratio, and an amount of precipitates in the weld metal was as follows. Oxalic acid etching was performed on the weld metal in accordance with JIS G 0571: 2003. An electrolytic current was 0.1 A per 1 $cm^2$. Using a photograph taken with an optical microscope at a magnification of 500 times with respect to an etched surface after etching, a measurement area in a range of 200 μm×200 μm was photographed in 10 fields of view, and measurement was performed in each of the fields of view by a point counting method specified in ASTM E 562. That is, when a 10 mm grid is drawn on the photograph and the number of grid points is 100, a ratio of the number of ferrites or precipitates present on the grid points was defined as the fraction (volume %) of the ferrite phase or the amount of precipitates (area %) in the weld metal.

For the hardness of the base material and the hardness of the weld metal, the hardness was measured at an arbitrary 10 points in each with a load of 100 gf the Vickers hardness test, and an average value of 8 points excluding a minimum value and a maximum value was obtained.

Furthermore, the proof stress of the base material and the proof stress of the welded joint containing the weld metal were measured. The proof stress of the base material and the proof stress of the weld were measured by a tensile test, and the test was carried out under the conditions in accordance with JIS Z 2241: 2011. For the proof stress of the base material, a JIS No. 13 B test piece was prepared, a test of n=2 was carried out, and a lower value was adopted. For the proof stress of the welded part, when a JIS No. 13 B test piece in which the welded portion is disposed at a center of a parallel portion of the test piece is prepared, and when the welded portion is thicker than the base material and is in a built-up state, grinding was performed to match the cross-sectional area shape with a parallel portion of the base material. The test of n=2 was carried out and a lower value was adopted. It was determined to be passed when the proof stress of the base material was 500 MPa or more, and the proof stress of the tensile test piece containing the weld metal was 440 MPa or more.

In addition, a dry and wet cycle accelerated corrosion test was conducted in accordance with JIS G 0597: 2017. The test period was 20 cycles. The appearance of the weld metal after the test was observed, and the presence or absence of rust was visually confirmed.

As shown in Table 4 and FIG. 1, in Examples No. 1 to 15 of the present invention, no rust was generated in the weld metal, and the proof stress of the base material and the proof stress of the welded portion were also satisfactory values. On the other hand, in Comparative examples Nos. 16 to 36, rust was generated in the weld metal, and the proof stress of the welded portion was not a satisfactory value for some samples.

TABLE 1

| | Chemical composition (mass %) of base material The remainder: Fe and impurities | | | | | | | | | | | | |
|---|---|---|---|---|---|---|---|---|---|---|---|---|---|
| Kind of base material | C | Si | Mn | P | S | Ni | Cr | Mo | Cu | N | First group (Al, Ti, Nb, V, W; Ta, Zr, Sn, Sb, Ga) | Second group (B, Ca, Mg, REM) | Note |
| a1 | 0.005 | 0.35 | 1.90 | 0.035 | 0.0012 | 2.3 | 20.8 | 0.530 | 2.700 | 0.088 | | | Example of the present invention |
| a2 | 0.014 | 0.90 | 1.62 | 0.026 | 0.0006 | 6.4 | 23.1 | 0.811 | 1.200 | 0.267 | | B: 0.0008 | |
| a3 | 0.021 | 0.51 | 1.31 | 0.027 | 0.0008 | 5.3 | 23.8 | 1.404 | 0.500 | 0.167 | Ti: 0.012, Nb: 0.04, V: 0.10 | B: 0.0018, Ca: 0.0015 | |
| a4 | 0.021 | 0.87 | 2.11 | 0.016 | 0.0014 | 4.1 | 29.4 | 1.102 | 3.100 | 0.181 | | | |
| a5 | 0.013 | 1.40 | 2.70 | 0.021 | 0.0009 | 3.1 | 21.6 | 0.703 | 0.500 | 0.332 | | B: 0.0005, REM: 0.05 | |
| a6 | 0.016 | 0.43 | 2.93 | 0.035 | 0.0011 | 7.2 | 29.6 | 0.313 | 0.600 | 0.154 | Ti: 0.014, Ta: 0.003 | | |
| a7 | 0.011 | 1.20 | 3.50 | 0.021 | 0.0010 | 3.5 | 23.9 | 0.920 | 1.800 | 0.271 | | | |
| a8 | 0.018 | 0.37 | 1.87 | 0.025 | 0.0007 | 5.8 | 23.2 | 2.032 | 0.700 | 0.179 | Nb: 0.05 | Mg: 0.0008 | |
| a9 | 0.042 | 0.16 | 1.72 | 0.031 | 0.0006 | 1.9 | 17.3 | 0.802 | 0.800 | 0.138 | Sn: 0.03 | | |
| a10 | 0.028 | 0.73 | 2.41 | 0.022 | 0.0003 | 1.4 | 15.2 | 1.613 | 1.300 | 0.271 | Sb: 0.08, Ga: 0.01 | | |
| a11 | 0.018 | 0.43 | 1.44 | 0.018 | 0.0014 | 4.8 | 22.5 | 1.804 | 0.310 | 0.172 | | REM: 0.03 | |
| a12 | 0.012 | 4.30 | 2.87 | 0.025 | 0.0011 | 2.2 | 23.7 | 3.080 | 1.200 | 0.242 | Al: 0.04, W: 0.6 | | |
| a13 | 0.028 | 0.73 | 0.08 | 0.022 | 0.0003 | 1.4 | 15.2 | 1.820 | 1.300 | 0.431 | Sb: 0.08, Ga: 0.01, Zr: 0.060 | | |
| a14 | 0.018 | 0.05 | 6.54 | 0.018 | 0.0014 | 4.8 | 22.5 | 1.530 | 0.030 | 0.172 | | REM: 0.03 | |
| a15 | 0.017 | 0.53 | 2.87 | 0.025 | 0.0011 | 15.2 | 28.7 | 0.028 | 1.200 | 0.072 | Al: 0.04, W: 0.6 | | |
| a16 | 0.004 | 0.47 | 3.10 | 0.028 | 0.0026 | 3.1 | 20.5 | 1.200 | 1.418 | 0.314 | Zr: 0.060 | | |

TABLE 2

| | Chemical composition (mass %) of base material The rest: Fe and impurities | | | | | | | | | | | | |
|---|---|---|---|---|---|---|---|---|---|---|---|---|---|
| Kind of base material | C | Si | Mn | P | S | Ni | Cr | Mo | Cu | N | First group (Al, Ti, Nb, V, W, Ta, Zr, Sn, Sb, Ga) | Second group (B, Ca, Mg, REM) | Note |
| b1 | 0.056 | 0.21 | 3.40 | 0.025 | 0.0021 | 1.2 | 20.1 | 1.300 | 0.612 | 0.168 | | | Comparative examples |
| b2 | 0.014 | 0.01 | 2.90 | 0.021 | 0.0029 | 1.4 | 21.1 | 2.500 | 0.822 | 0.204 | | | |
| b3 | 0.025 | 0.47 | 3.40 | 0.075 | 0.0041 | 2.1 | 19.1 | 1.100 | 1.916 | 0.160 | | | |
| b4 | 0.031 | 0.38 | 4.60 | 0.025 | 0.0061 | 0.9 | 21.3 | 0.800 | 0.800 | 0.229 | | | |
| b5 | 0.022 | 0.32 | 4.20 | 0.028 | 0.0037 | 0.6 | 20.8 | 3.600 | 0.368 | 0.238 | | | |
| b6 | 0.021 | 0.29 | 3.80 | 0.033 | 0.0040 | 1.6 | 12.9 | 4.500 | 0.641 | 0.195 | | | |
| b7 | 0.016 | 0.49 | 3.60 | 0.035 | 0.0017 | 1.4 | 20.9 | 0.005 | 0.428 | 0.236 | | | |
| b8 | 0.013 | 2.11 | 3.20 | 0.045 | 0.0008 | 1.6 | 19.5 | 1.800 | 0.006 | 0.201 | | | |
| b9 | 0.020 | 0.68 | 2.70 | 0.031 | 0.0011 | 1.0 | 20.3 | 1.400 | 0.998 | 0.034 | | | |
| b10 | 0.027 | 3.56 | 6.80 | 0.041 | 0.0020 | 2.6 | 20.5 | 1.200 | 0.655 | 0.147 | Al: 1.10, Ti: 0.500 | | |
| b11 | 0.017 | 5.50 | 2.80 | 0.028 | 0.0016 | 1.6 | 19.3 | 2.300 | 1.508 | 0.120 | | | |
| b12 | 0.023 | 0.94 | 9.40 | 0.031 | 0.0011 | 1.1 | 20.8 | 3.700 | 1.809 | 0.168 | | | |
| b13 | 0.023 | 0.16 | 3.60 | 0.030 | 0.0014 | 32.1 | 28.4 | 5.500 | 0.112 | 0.045 | | | |
| b14 | 0.019 | 0.38 | 8.50 | 0.015 | 0.0020 | 7.6 | 33.8 | 1.600 | 1.204 | 0.558 | | | |
| b15 | 0.014 | 4.88 | 4.10 | 0.025 | 0.0038 | 12.3 | 22.7 | 9.300 | 2.108 | 0.364 | | | |
| b16 | 0.008 | 0.41 | 7.90 | 0.030 | 0.0012 | 2.0 | 21.0 | 1.400 | 6.117 | 0.174 | | | |
| b17 | 0.011 | 0.38 | 2.40 | 0.025 | 0.0011 | 1.8 | 21.4 | 1.200 | 0.884 | 0.819 | | | |
| b18 | 0.021 | 0.36 | 3.40 | 0.026 | 0.0024 | 11.1 | 20.1 | 3.500 | 0.910 | 0.167 | Al: 0.04, Nb: 0.05, W: 1.1, Sn: 0.03 | B: 0.0020, Ca: 0.0028 | |

TABLE 2-continued

| Kind of base material | Chemical composition (mass %) of base material The rest: Fe and impurities | | | | | | | | | | | | |
|---|---|---|---|---|---|---|---|---|---|---|---|---|---|
| | C | Si | Mn | P | S | Ni | Cr | Mo | Cu | N | First group (Al, Ti, Nb, V, W, Ta, Zr, Sn, Sb, Ga) | Second group (B, Ca, Mg, REM) | Note |
| b19 | 0.014 | 0.34 | 3.30 | 0.031 | 0.0039 | 1.7 | 20.6 | 2.800 | 1.226 | 0.253 | Ti: 0.020, Nb: 0.60, V: 0.07, Ta: 0.150 | | |
| b20 | 0.004 | 0.47 | 3.10 | 0.028 | 0.0026 | 3.1 | 20.5 | 1.200 | 1.418 | 0.314 | Al: 1.10, Ti: 0.600, Ga: 0.60 | B: 0.0023, REM: 0.20 | |

The underline indicates that it is outside the scope of the present invention.

TABLE 3

| No. | Kind of base material | Kind | Sheet thickness (mm) | Welding method | Welding wire | Atmosphere Shield gas |
|---|---|---|---|---|---|---|
| 1 | a1 | Examples of the present invention | 0.8 | TIG | None | $N_2$ |
| 2 | a2 | | 1.2 | TIG | Type 2209 | Ar |
| 3 | a3 | | 1.0 | TIG | None | Ar |
| 4 | a5 | | 0.8 | TIG | None | $N_2$ |
| 5 | a6 | | 1.0 | TIG | None | $N_2$ |
| 6 | a7 | | 1.2 | TIG | None | Ar |
| 7 | a8 | | 4.0 | MIG | Y308L | Ar + $O_2$ |
| 8 | a9 | | 1.0 | TIG | None | Ar |
| 9 | a11 | | 3.5 | MIG | ER308LSi | Ar + $O_2$ |
| 10 | a4 | | 1.0 | TIG | None | He |
| 11 | a10 | | 0.6 | TIG | Type2209 | Ar |
| 12 | a12 | | 4.5 | MIG | ER308LSi | $N_2$ |
| 13 | a13 | | 5.0 | MAG | ER308LSi | Ar |
| 14 | a14 | | 1.5 | TIG | Type2209 | $N_2$ |
| 15 | a15 | | 0.8 | TIG | None | Ar |
| 16 | b1 | Comparative examples | 1.5 | TIG | None | Ar |
| 17 | b2 | | | | None | Ar |
| 18 | b3 | | | | None | $N_2$ |
| 19 | b4 | | | | None | $N_2$ |

TABLE 3-continued

| No. | Kind of base material | Kind | Sheet thickness (mm) | Welding method | Welding wire | Atmosphere Shield gas |
|---|---|---|---|---|---|---|
| 20 | b5 | | | | 308 | $N_2$ |
| 21 | b6 | | | | None | $N_2$ |
| 22 | b7 | | | | None | Ar |
| 23 | b8 | | | | 309 MoL | Ar |
| 24 | b9 | | | | None | Ar |
| 25 | b10 | | | | None | Ar |
| 26 | b11 | | | | None | $N_2$ |
| 27 | b12 | | | | None | $N_2$ |
| 28 | b13 | | | | None | Ar |
| 29 | b14 | | | | None | $N_2$ |
| 30 | b15 | | | | None | Ar |
| 31 | b16 | | | | None | Ar |
| 32 | b17 | | | | Type 2209 | Ar |
| 33 | b18 | | | | Type 2209 | $N_2$ |
| 34 | b19 | | | | None | Ar |
| 35 | b20 | | | | None | $N_2$ |
| 36 | a16 | | | | None | Ar + $N_2$ |

TABLE 4

| No. | Kind of base material | Volume fraction of ferrite phase Weld metal (%) | Hardness of base material (HV0.1) | Hardness of weld metal (HV0.1) | Hardness ratio | Area fraction of precipitates in ferrite phase (%) | Proof stress of base material (MPa) | Proof stress of welded portion (MPa) | Presence or absence of rust | Kind |
|---|---|---|---|---|---|---|---|---|---|---|
| 1 | a1 | 50 | 212 | 182 | 0.86 | 6 | 551 | 489 | Absence | Examples of the present invention |
| 2 | a2 | 70 | 230 | 241 | 1.05 | 8 | 598 | 553 | Absence | |
| 3 | a3 | 60 | 243 | 210 | 0.86 | 5 | 631 | 589 | Absence | |
| 4 | a5 | 55 | 210 | 178 | 0.85 | 8 | 547 | 486 | Absence | |
| 5 | a6 | 50 | 238 | 228 | 0.96 | 8 | 618 | 573 | Absence | |
| 6 | a7 | 60 | 200 | 174 | 0.87 | 6 | 521 | 467 | Absence | |
| 7 | a8 | 75 | 214 | 203 | 0.95 | 6 | 556 | 473 | Absence | |
| 8 | a9 | 70 | 199 | 192 | 0.96 | 8 | 517 | 460 | Absence | |
| 9 | a11 | 70 | 247 | 218 | 0.88 | 8 | 641 | 611 | Absence | |
| 10 | a4 | 45 | 231 | 203 | 0.88 | 2 | 662 | 636 | Absence | |
| 11 | a10 | 55 | 223 | 211 | 0.95 | 3 | 612 | 567 | Absence | |
| 12 | a12 | 70 | 227 | 199 | 0.88 | 6 | 606 | 577 | Absence | |
| 13 | a13 | 70 | 212 | 185 | 0.87 | 8 | 593 | 505 | Absence | |
| 14 | a14 | 55 | 226 | 207 | 0.92 | 6 | 612 | 601 | Absence | |
| 15 | a15 | 65 | 212 | 189 | 0.89 | 7 | 627 | 601 | Absence | |
| 16 | b1 | 50 | 223 | 188 | 0.84 | 15 | 581 | 526 | Presence | Comparative examples |
| 17 | b2 | 55 | 217 | 189 | 0.87 | 20 | 563 | 528 | | |
| 18 | b3 | 65 | 227 | 193 | 0.85 | 30 | 589 | 539 | | |
| 19 | b4 | 55 | 208 | 174 | 0.84 | 20 | 542 | 487 | | |
| 20 | b5 | 55 | 215 | 176 | 0.82 | 25 | 559 | 492 | | |
| 21 | b6 | 60 | 205 | 173 | 0.84 | 15 | 533 | 484 | | |
| 22 | b7 | 50 | 232 | 196 | 0.84 | 15 | 602 | 549 | | |
| 23 | b8 | 60 | 237 | 190 | 0.80 | 20 | 615 | 533 | | |
| 24 | b9 | 55 | 195 | 164 | 0.84 | 20 | 508 | 459 | | |
| 25 | b10 | 80 | 212 | 154 | 0.73 | 25 | 551 | 432 | | |

TABLE 4-continued

| No. | Kind of base material | Volume fraction of ferrite phase Weld metal (%) | Hardness of base material (HV0.1) | Hardness of weld metal (HV0.1) | Hardness ratio | Area fraction of precipitates in ferrite phase (%) | Proof stress of base material (MPa) | Proof stress of welded portion (MPa) | Presence or absence of rust | Kind |
|---|---|---|---|---|---|---|---|---|---|---|
| 26 | b11 | 60 | 211 | 180 | 0.85 | 20 | 549 | 505 | | |
| 27 | b12 | 65 | 210 | 179 | 0.85 | 25 | 546 | 501 | | |
| 28 | b13 | 40 | 193 | 143 | 0.74 | 20 | 502 | 401 | | |
| 29 | b14 | 55 | 242 | 212 | 0.88 | 15 | 628 | 594 | | |
| 30 | b15 | 80 | 216 | 149 | 0.69 | 15 | 561 | 418 | | |
| 31 | b16 | 80 | 224 | 152 | 0.68 | 30 | 583 | 426 | | |
| 32 | b17 | 70 | 196 | 167 | 0.85 | 25 | 510 | 468 | | |
| 33 | b18 | 65 | 240 | 206 | 0.86 | 25 | 624 | 577 | | |
| 34 | b19 | 50 | 224 | 183 | 0.82 | 20 | 582 | 513 | | |
| 35 | b20 | 55 | 224 | 188 | 0.84 | 15 | 582 | 525 | | |
| 36 | a16 | 50 | 236 | 214 | 0.91 | 15 | 601 | 533 | | |

The underline indicates that it is outside the scope of the present invention.

INDUSTRIAL APPLICABILITY

According to the above aspect of the present invention, it is possible to provide a welded structure made of duplex stainless steel having exceptional proof stress and exceptional corrosion resistance in a welded portion, and a storage tank having such a welded structure.

What is claimed is:

1. A welded structure including a base material made of duplex stainless steel and a welded portion in which the base materials are welded to each other, wherein a chemical composition of the base material includes, in mass %, C: 0.050% or less,
Si: 0.03 to 5.00%,
Mn: 0.01 to 8.00%,
P: 0.070% or less,
S: 0.0500% or less,
Ni: 1.0 to 30.0%,
Cr: 15.0 to 30.0%,
Mo: 0.010 to 8.000%,
Cu: 0.010 to 5.000%,
N: 0.050 to 0.800%,
Al: 0 to 1.00%,
Ti: 0 to 0.400%,
Nb: 0 to 0.40%,
V: 0 to 0.50%,
W: 0 to 1.0%,
Zr: 0 to 0.200%,
Ta: 0 to 0.100%,
Sn: 0 to 0.50%,
Sb: 0 to 0.50%,
Ga: 0 to 0.50%,
B: 0 to 0.0050%,
Ca: 0 to 0.0050%,
Mg: 0 to 0.0050%, and
REM: 0 to 0.10%, and
the remainder of Fe and impurities, a volume fraction of a ferrite phase in a metallographic structure of a weld metal of the welded portion is 45 to 75%, a ratio of a hardness of the weld metal to a hardness of the base material is 0.80 to 1.20, and an amount of precipitates formed in the ferrite phase of the weld metal is less than 10% in area fraction.

2. The welded structure according to claim 1, wherein the base material contains one or more selected from the following, in mass %

Al: 1.00% or less,
Ti: 0.010 to 0.400%,
Nb: 0.01 to 0.40%,
V: 0.01 to 0.50%,
W: 0.01 to 1.0%,
Zr: 0.001 to 0.200%,
Ta: 0.001 to 0.100%,
Sn: 0.001 to 0.50%,
Sb: 0.001 to 0.50%,
Ga: 0.001 to 0.50%;
B: 0.0002 to 0.0050%,
Ca: 0.0002 to 0.0050%,
Mg: 0.0002 to 0.0050%, and
REM: 0.001 to 0.10%.

3. The welded structure according to claim 1, wherein a proof stress of the base material is 500 MPa or more, and a proof stress of the welded portion is 440 MPa or more.

4. The welded structure according to claim 2, wherein a proof stress of the base material is 500 MPa or more, and a proof stress of the welded portion is 440 MPa or more.

5. A welded structure according to claim 1, which is for a storage tank for hot water.

6. A welded structure according to claim 1, which is for a storage tank for beverages.

7. A storage tank for liquids, which has the welded structure according to claim 1.

8. The storage tank according to claim 7, wherein the liquid is one or more of water, beverages, hot water, and dairy products.

* * * * *